US006190210B1

(12) United States Patent
Belopolsky et al.

(10) Patent No.: US 6,190,210 B1
(45) Date of Patent: Feb. 20, 2001

(54) LOW PROFILE MODULAR JACK

(75) Inventors: Yakov Belopolsky, Harrisburg, PA (US); Gary J. Oleynick, Encinitas, CA (US)

(73) Assignee: Berg Technology, Inc., Reno, NV (US)

( * ) Notice: Under 35 U.S.C. 154(b), the term of this patent shall be extended for 0 days.

(21) Appl. No.: 09/266,049

(22) Filed: Mar. 10, 1999

(51) Int. Cl.[7] ..... H01R 24/00
(52) U.S. Cl. ..... 439/676
(58) Field of Search ..... 439/676, 344

(56) References Cited

U.S. PATENT DOCUMENTS

| | | | | |
|---|---|---|---|---|
| 3,850,497 | | 11/1974 | Krumreich et al. | 339/126 R |
| 3,954,320 | | 5/1976 | Hardesty | 339/99 R |
| 4,193,654 | | 3/1980 | Hughes et al. | 339/17 LC |
| 4,457,570 | | 7/1984 | Bogese, II | 339/17 C |
| 4,497,526 | | 2/1985 | Myers | 339/17 LC |
| 4,583,807 | | 4/1986 | Kaufman et al. | 339/125 R |
| 4,647,136 | | 3/1987 | Kinoshita et al. | 339/125 R |
| 4,698,025 | | 10/1987 | Silbernagel et al. | 439/79 |
| 4,915,655 | | 4/1990 | Tanaka | 439/676 |
| 5,035,641 | * | 7/1991 | Van-Santbrink et al. | 439/329 |
| 5,118,311 | * | 6/1992 | Margini | 439/676 |
| 5,364,294 | * | 11/1994 | Hatch et al. | 439/676 |
| 5,378,172 | * | 1/1995 | Roberts | 439/676 |
| 5,456,619 | | 10/1995 | Belopolsky et al. | 439/620 |
| 5,702,271 | | 12/1997 | Steinman | 439/676 |
| 5,759,070 | * | 6/1998 | Belopolsky | 439/676 |
| 5,915,993 | * | 6/1999 | Belopolsky et al. | 439/676 |

OTHER PUBLICATIONS

Berg Electronics Catalog, "Telephone Interconnection Systems: PCB Modular Jacks," Jan., 1998, 27–8 thru 27–11.

* cited by examiner

*Primary Examiner*—Khiem Nguyen
*Assistant Examiner*—Hae Moon Hyeon
(74) *Attorney, Agent, or Firm*—Woodcock Washburn Kurtz Mackiewicz & Norris LLP

(57) ABSTRACT

A receptacle and printed circuit board combination for receiving a telecommunications plug and achieving electrical connection between the plug and the printed circuit board is provided. The combination occupies a minimum required amount of space and requires a minimum amount of material. The combination comprises an insulating housing, a plurality of electrical contacts, and a printed circuit board, wherein the housing and circuit board form a plug receiving opening. The printed circuit board has a cut-out portion for receiving the receptacle. Preferably, the receptacle further comprises two latches extending from a bottom surface of the housing for mounting the receptacle on the circuit board, wherein the cutout portion of the circuit board receives the peg. In certain preferred embodiments, the housing further comprises two ledges, each extending from a sidewall of the housing. In additional preferred embodiments, the ledges have respective ledge extensions extending down from the ledges at the front of the housing to help anchor the receptacle in place on the circuit board by making contact with a leading edge of the circuit board. In other preferred embodiments, the ledge extensions have respective lips extending from the ledge extensions toward each other such that the receptacle can receive a latch arm of the telecommunications plug.

17 Claims, 8 Drawing Sheets

LOW PROFILE MODULAR JACK

FIELD OF THE INVENTION

The present invention relates to electrical connector receptacles, and more particularly to receptacles for receiving telecommunications data/voice line plugs.

BACKGROUND OF THE INVENTION

Electrical connector receptacles for receiving telecommunications data/voice line plugs are most commonly used to interconnect telephone lines. Such telecommunication jacks are used to connect telephone lines and telephones (transmitting voice signals) or telephone lines and computers (transmitting data and/or voice signals).

U.S. Pat. No. 3,850,497 describes a connector receptacle of a type which is intended for use in the telephone industry. This receptacle comprises an insulating housing having a plug-receiving end and a plug-receiving opening extending into the plug-receiving end. A plurality of circular openings extend through the housing from the plug-receiving end to the rearward end of the housing and contact springs extending from these circular openings diagonally into the plug-receiving opening so that when a plug is inserted into the receptacle, the contact members on the plug engage the contact springs. The contact springs are in the form of wires and are connected by means of crimped electrical connections to lead wires. These crimped connections are contained in the circular openings in the housing and the lead wires extend from the circular openings and away from the housing at the rearward end thereof. The most commonly used type of connector plug which is intended to be mated with connector receptacles of the type described above is described in U.S. Pat. No. 3,954,320.

The connector receptacle described in U.S. Pat. No. 3,850,497 has been widely adopted in the telephone industry and other equipment such as data processing equipment which may be installed adjacent to a telephone exchange, personal computers, and similar equipment. The use of these connector receptacles in such related equipment often requires that the receptacle be mounted on a printed circuit board (PCB), also referred to as a printed wiring board (PWB).

So that telecommunications receptacles can be easily and readily mounted on PCB's, the receptacle of U.S. Pat. No. 3,850,497 is modified to have formed electrical conductors rather than wire type conductors and one end of each formed conductor extends beyond the housing of the connector so that the connector can be mounted on a PCB with the ends of the conductors extending into openings, or through holes, in the PCB. These ends of the conductors can then be soldered to conductors on the PCB in the usual manner.

Space on PCB's of computer-related equipment, however, is always at a premium. It is, therefore, to provide a receptacle for receiving a telecommunications plug that can be mounted on a PCB and occupy the minimum required amount of space on the board.

SUMMARY OF THE INVENTION

A receptacle and printed circuit board combination for receiving a plug and achieving electrical connection between the plug and the printed circuit board is provided. The combination occupies a minimum required amount of space and requires a minimum amount of material. The combination comprises an insulating housing, a plurality of electrical contacts, and a printed circuit board, wherein the housing and circuit board form a plug receiving opening.

The housing has a front, rear, bottom surface and top wall situated above the circuit board. Each electrical contact has a first end portion extending within the opening for engaging the plug, and a second end portion fixed to terminals on the circuit board. The printed circuit board has a cut-out portion for receiving the receptacle.

The receptacle, which comprises the housing and electrical contacts, further comprises a peg extending from the bottom surface of the housing for mounting the receptacle on the circuit board, wherein the cut-out portion of the circuit board receives the peg. Preferably, the receptacle comprises two pegs and more preferably, the pegs are latches. In addition, the cut-out portion has a substantially rectangular shape.

In certain preferred embodiments, the housing further comprises two side walls extending between the top wall and the bottom surface, and two ledges, wherein each ledge extends from each side wall at the plane of the bottom surface such that an underside of the ledges is coplanar with the bottom surface such that the bottom surface and the ledges make contact with the circuit board when mounted on the circuit board. Preferably, the two ledges extend from their respective side walls toward each other.

In additional preferred embodiments, the ledges have respective ledge extensions extending down and substantially perpendicularly from the ledges at the front of the housing to help anchor the receptacle in place on the circuit board by making contact with a leading edge of the circuit board. In yet other preferred embodiments, the ledge extensions have respective lips extending from the ledge extensions toward each other such that the receptacle can receive a latch arm of the telecommunications plug. In certain other preferred embodiments, the lips are joined together by a connecting member extending between lower surfaces of the two lips.

In additional preferred embodiments, the insulating housing is located a distance from the circuit board and the printed circuit board has a cut-out portion for receiving a latch arm on the plug. Preferably, the cut-out portion is defined by a first substantially rectangular section and a smaller substantially rectangular extension adjacent a leading edge of the circuit board.

A receptacle for receiving a telecommunications plug and achieving electrical connection between the plug and a printed circuit board also is provided. This receptacle comprises an insulating housing and a plurality of electrical contacts. The housing has only a top wall having a front and rear, and a rear wall, wherein the top wall is situated above the circuit board and the housing and circuit board form a plug receiving opening. Each electrical contact has an end portion serving as a contact spring that extends from the top wall at a location proximate the front of the housing across the opening to a location proximate the rear of the housing. The electrical contacts extend from the contact springs at the area proximate the front of the top wall across the top wall toward the rear of the top wall down through the rear wall to meet the circuit board where they are fixed in place to effect an electrical connection with terminals on the circuit board.

DETAILED DESCRIPTION OF THE PREFERRED EMBODIMENTS

Figure 1:
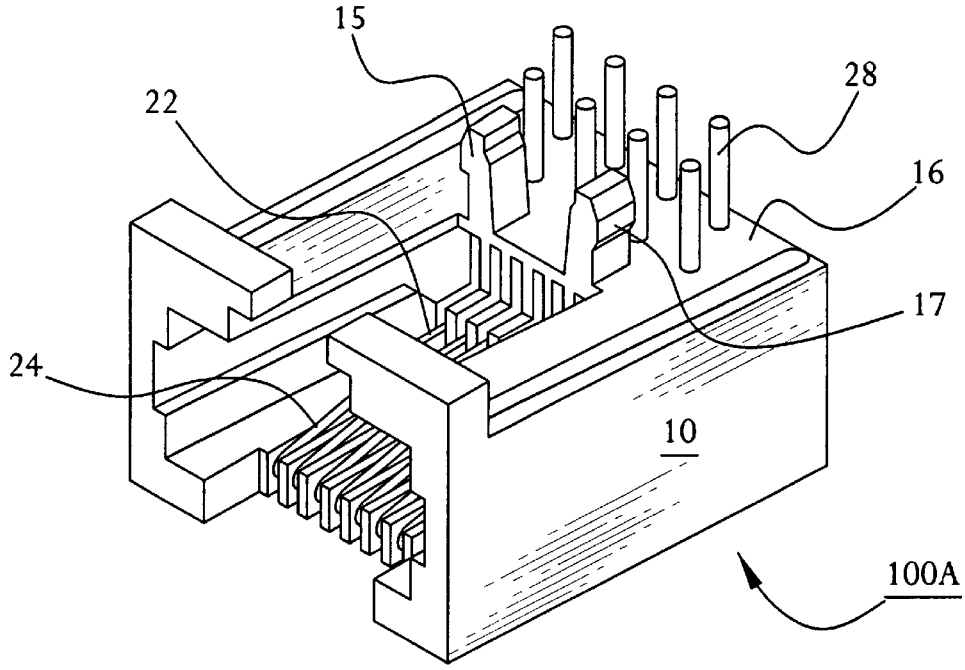
FIG. 1 is a bottom isometric view of a first preferred embodiment of a receptacle of the present invention.
Figure 3:
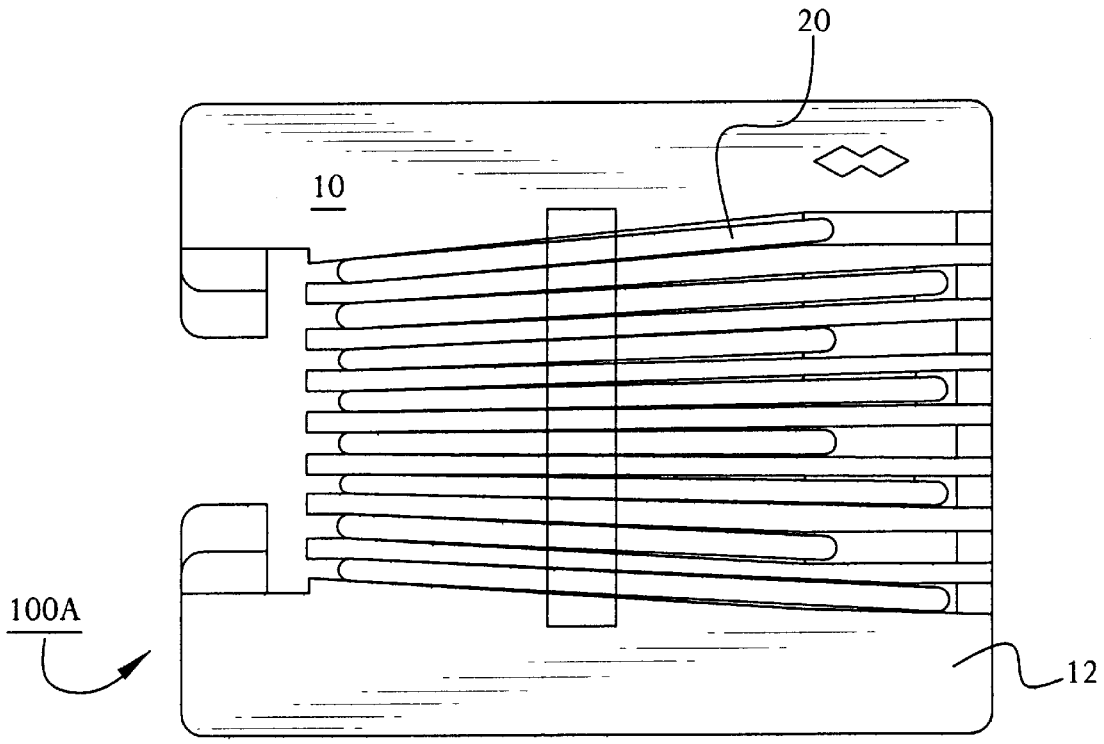
FIG. 3 is a top view of the receptacle of FIG. 1.
Figure 4:
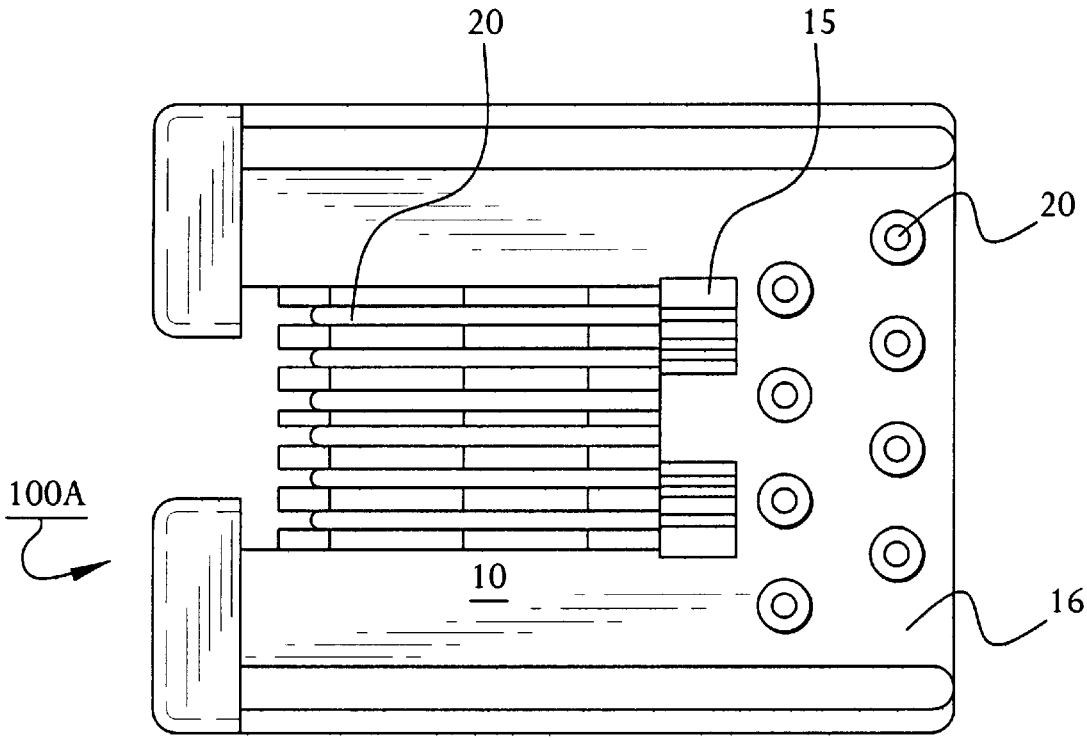
FIG. 4 is a bottom view of the receptacle of FIG. 1.

A low profile modular jack (or receptacle) that can be mounted on a printed circuit board (PCB) for receiving a telecommunications plug is provided. A bottom isometric view of a preferred embodiment of a receptacle of the present invention is shown in FIG. 1. A top isometric view of the receptacle 100A of FIG. 1 is shown is FIG. 2. The receptacle 100A comprises an insulating housing 10 and electrical contacts 20, and is mounted on a modified portion of a PCB 30 or other substrate. A top view and a bottom view of the receptacle 100A of FIG. 1 are shown in FIGS. 3 and 4, respectively. A side view of the receptacle 100A of FIG. 1 is shown in FIG. 5.

Figure 5:
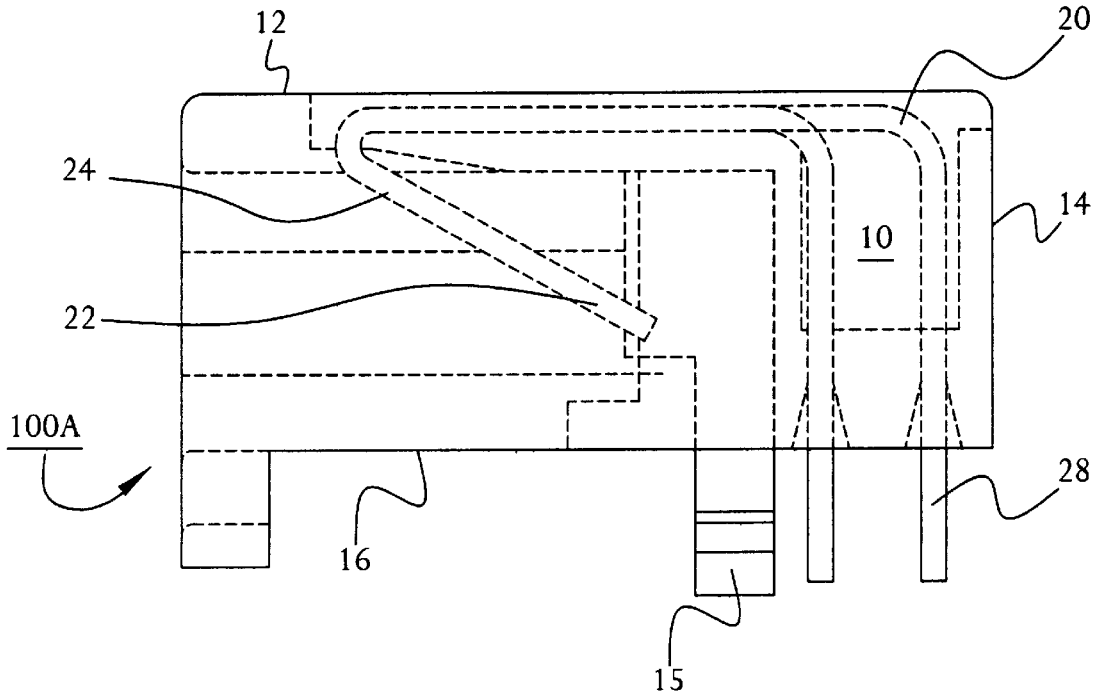
FIG. 5 is a side view of the receptacle of FIG. 1.

As best shown in FIG. 5, the housing 10 holds the contacts 20 in place and with the help of the PCB 30 forms a plug-receiving opening 40. The electrical contacts 20 are formed conductors, each having a first end portion 22 that serves as a contact spring 24 that extends from a location near the front of the top wall 12 of the housing 10 across the opening 40 to a location near the rear wall 14 of the housing 10. From the location near the front of the top wall 12 of the housing 10, the contacts 20 extend across the top wall 12 toward the rear wall 14 and then down to the PCB 30 where they terminate (at the second end portion 28) and are soldered in place to effect an electrical connection with the terminals 32 on the PCB 30.

Figure 6:
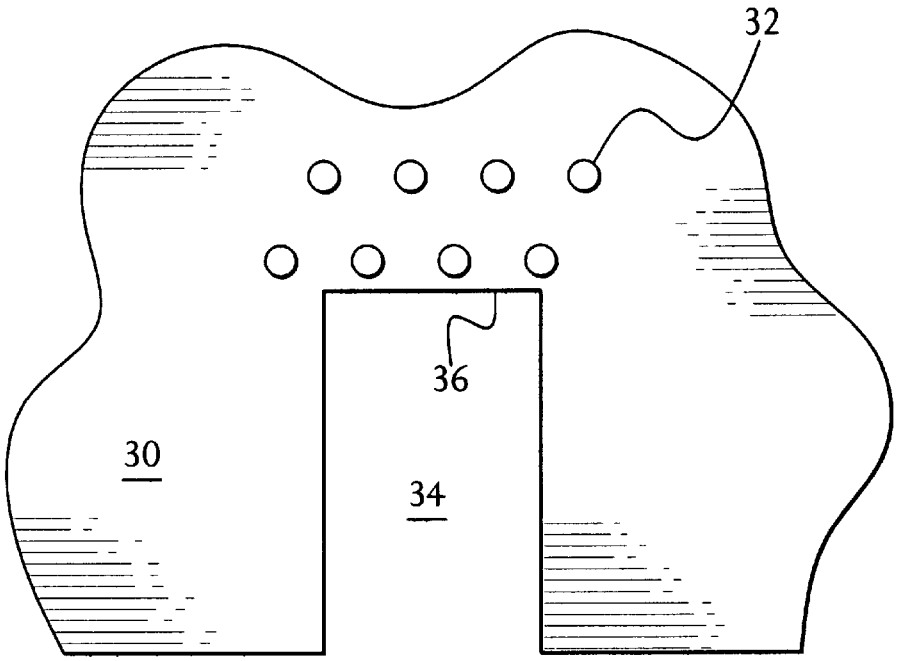
FIG. 6 is a top view of a portion of a modified PCB on which the receptacle of FIG. 1 is mounted.

A top view of a portion of the modified PCB 30 on which the receptacle 100A of FIG. 1 is mounted is shown in FIG. 6. FIG. 6 shows plated through holes 32 to which the contacts 20 are soldered and a cut-out portion 34 of the PCB 30 which receives the receptacle 100A of FIG. 1 and helps form the plug-receiving opening 40. As shown in FIG. 1, the bottom surface 16 of the housing 10 has two mounting pegs 15 projecting from the bottom surface 16. The pegs 15, in turn, have barbs 17 projecting therefrom. The pegs 15 facilitate mounting of the receptacle 100A on the PCB by latching into the cut-out portion 34 of the PCB 30, such as by latching opposed sides of the cut-out portion 34 proximate the rear side 36 of the cut-out portion 34. When inserted in place, the pegs 15 flex toward each other as the receptacle 100A is moved downward toward the PCB 30 until the barbs 17 reach the underside of the PCB 30. At this point, the pegs 15 resume a more relaxed state and the barbs 17 rest on the opposite surface of PCB 30 to thereby make accidental removal of the receptacle less likely to occur. So that mounting pegs 15 can engage opposed sides of the cut-out portion 34, the cut-out portion 34 spans the same distance that exists between ledges 42 and 44.

Figure 9:
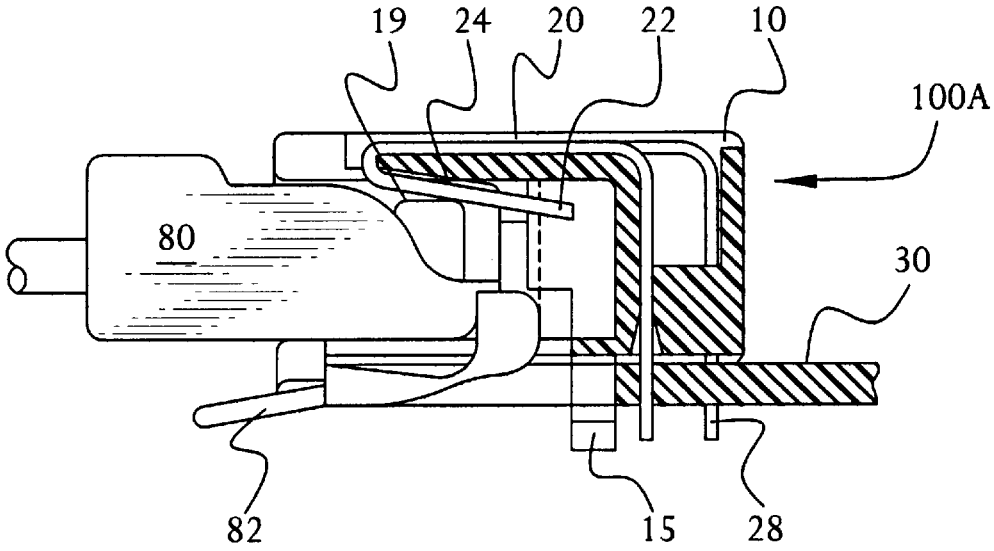
FIG. 9 is a side view of a telecommunications plug in cooperation with the receptacle of FIG. 1.
Figure 7:
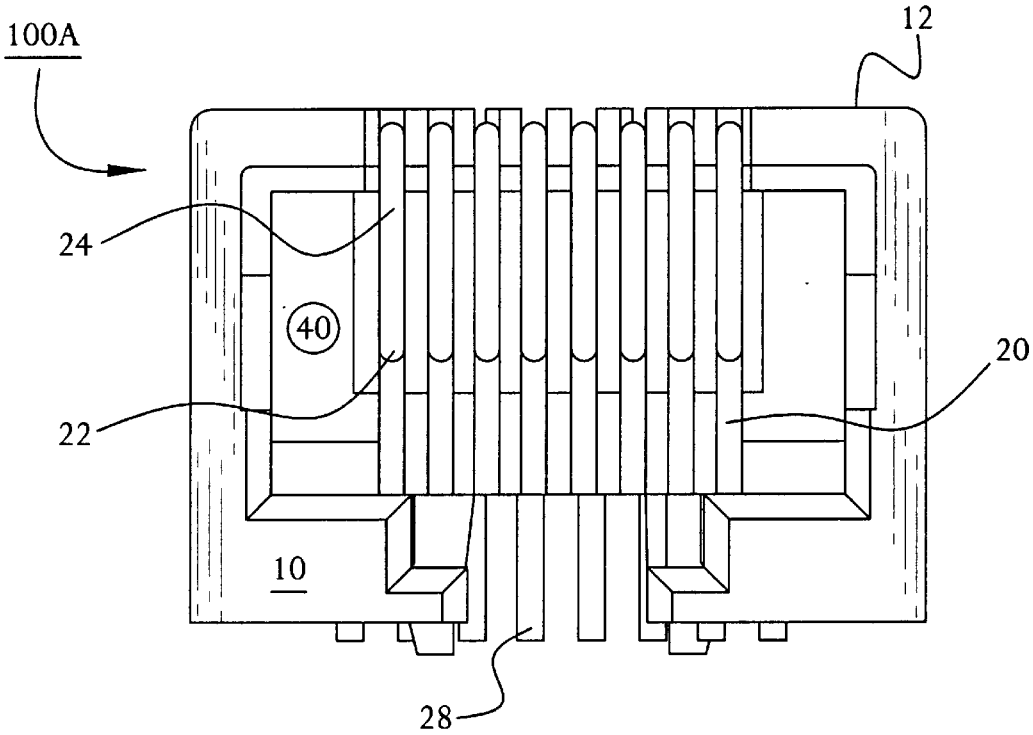
FIG. 7 is a front perspective view of the receptacle of FIG. 1.
Figure 8:
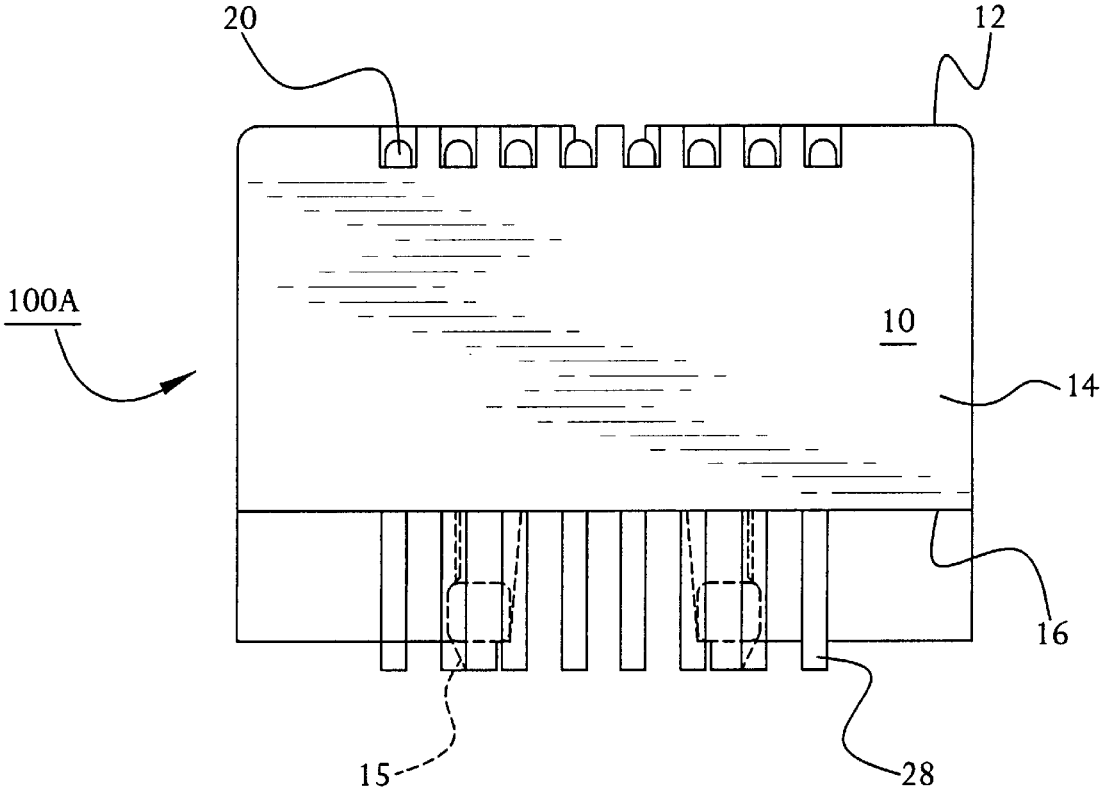
FIG. 8 is a rear view of the receptacle of FIG. 1.

FIGS. 7 and 8 show a front perspective and a rear view of the receptacle 100A of FIG. 1, respectively. FIG. 9 shows a side view of a telecommunications plug 80 such as a modular jack inserted in the plug-receiving opening 40 of the receptacle 100A of FIG. 1. When a telecommunications plug 80 is inserted into the plug-receiving opening 40 of the receptacle 100A, electrical contacts 19 of the plug 80 make electrical contact with the contact springs 24 of the receptacle 100A. When the plug 80 is fully inserted, the contact springs 24 flex upward toward the top wall 12 of the housing 10 and the latch arm 82 of the plug 80 engages complementary structure on housing 10 to detachably lock the plug 80 in place in the receptacle 100A.

Figure 2:
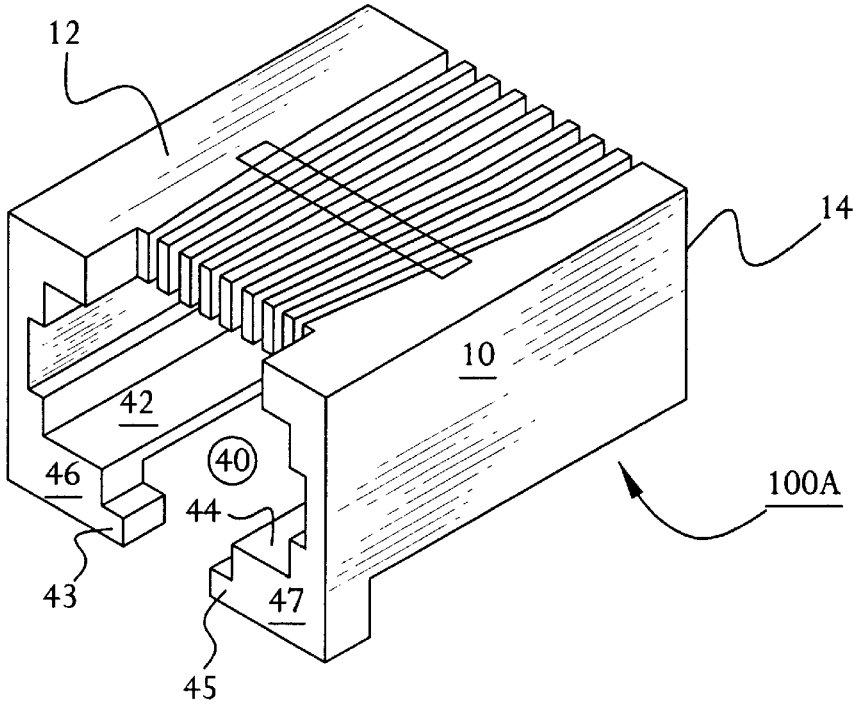
FIG. 2 is a top isometric view of the receptacle of FIG. 1.

As shown in FIG. 2, the housing 10 has two ledges 42 and 44 serving as the bottom wall of the housing 10. The two ledges 42 and 44 extend from their respective side walls of the housing 10. Ledges 42 and 44 rest on the upper surface of PCB 30. The ledges 42 and 44, being made from plastic, are typically smoother than PCB 30. This helps reduce wear on the plug 80.

Ledges 42 and 44 have respective ledge extensions 46 and 47 extending down and substantially perpendicularly from the ledges 42 and 44. When the receptacle 100A is mounted on the PCB 30, the ledge extensions 46 and 47 make contact with the leading edge of the PCB 30 and serve in helping to anchor the receptacle 100A in place on the PCB 30. These ledge extensions 46 and 47 have respective lips 43 and 45 extending therefrom toward the center of the housing 10, as shown in FIG. 2. The lips 43 and 44 serve to receive or "catch" the latch arm 82 of the plug 80. Preferably, the ledges 42 and 44 are smooth to reduce wear on the plug 80.

Figure 10:
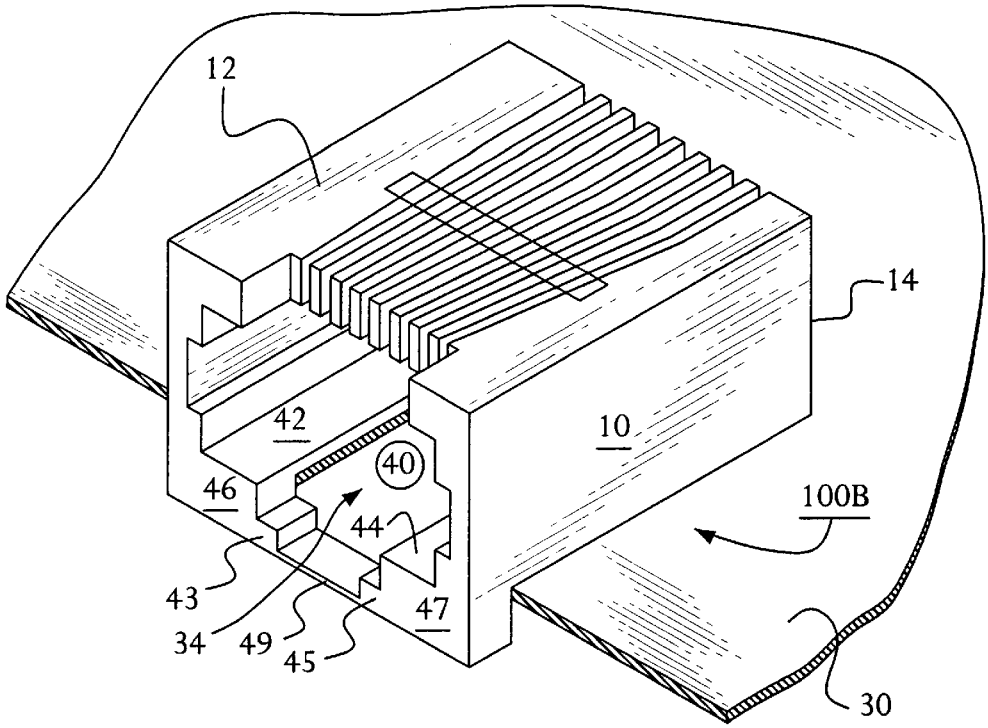
FIG. 10 is a top isometric view of a second preferred embodiment of a receptacle of the present invention.

As shown in FIGS. 1–9, the housing 10 of the receptacle 100A comprises a top wall 12, a rear wall 14, a bottom surface 16, two side walls, two ledges 42 and 44, and two mounting pegs 15. A top isometric view of a second preferred embodiment of a receptacle of the present invention is shown in FIG. 10. This receptacle 100B is a variation of receptacle 100A in which all features are generally identical, except that the two lips 43 and 45 are joined together by a connecting member 49 extending between the lower surfaces of the two lips 43 and 45. In this embodiment, the cut-out portion 34 of the PCB 30 is the same as that shown in FIG. 6, i.e., spans the same distance that exists between ledges 42 and 44, as shown in FIG. 10.

Figure 10A:
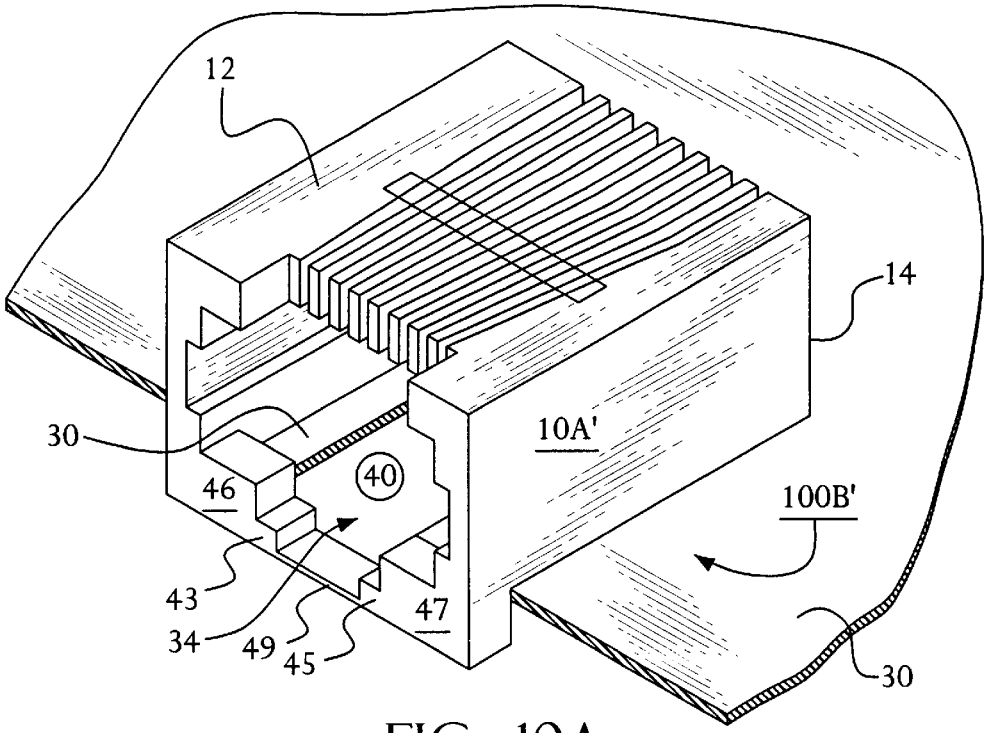
FIG. 10A is a top isometric view of a third preferred embodiment of a receptacle of the present invention.

A top isometric view of a third embodiment, receptacle 100B', is a variation of the receptacle 100B and is shown in FIG. 10A. Receptacle 100B' is similar to receptacle 100B, except that its housing 10B' lacks the ledges 42 and 44. Accordingly, the extensions 46 and 47 extend directly from their respective side walls of the housing 10. Since receptacle 100B' lacks ledges 42 and 44 resting on PCB 30, receptacle 100B' has a lower profile than receptacle 100B above PCB 30. In this embodiment as well, the cut-out portion 34 of the PCB 30 is the same as that shown in FIG. 6, i.e., has the same width. Therefore, because of the absence of ledges 42 and 44, a portion of the PCB 30 resides within the opening 40, as shown in FIG. 10A.

Figure 11:
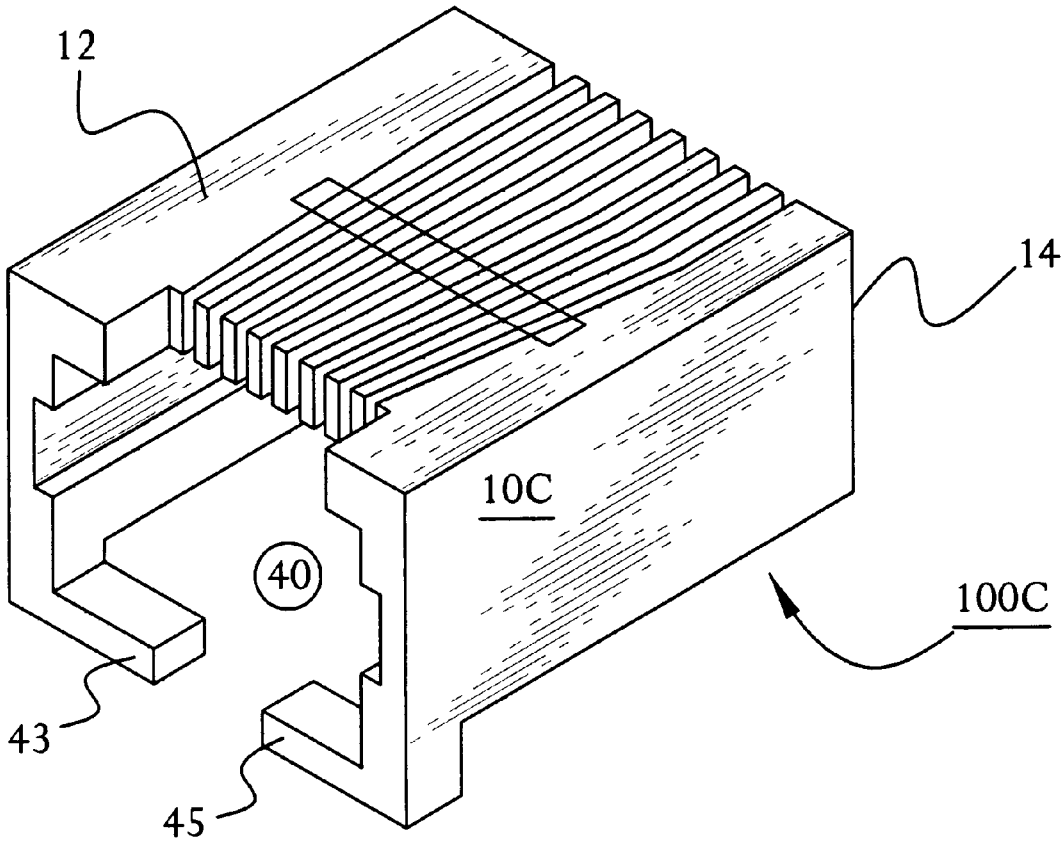
FIG. 11 is a top isometric view of a fourth preferred embodiment of a receptacle of the present invention.

A fourth preferred embodiment, receptacle 100C, of the present invention is a variation of receptacle 100B' and is shown in FIG. 11 in a top isometric view. As with receptacle 100B', housing 10C of receptacle 100C does not have ledges 42 and 44, but also is lacking the ledge extensions 46 and 47 and the connecting member 49. Accordingly, lips 43 and 45 extend directly from their respective side walls of the housing 10. PCB 30 could either abut lips 43 and 45 from behind, or PCB 30 could rest on top of lips 43 and 45.

Figure 13:
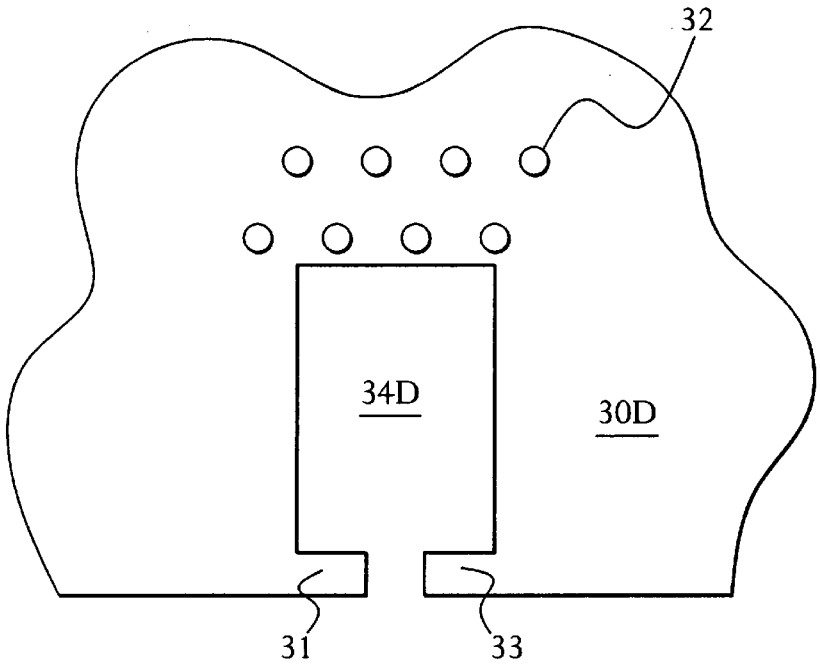
FIG. 13 a top view of a portion of a modified PCB on which the receptacle of FIG. 12 is mounted.
Figure 12:
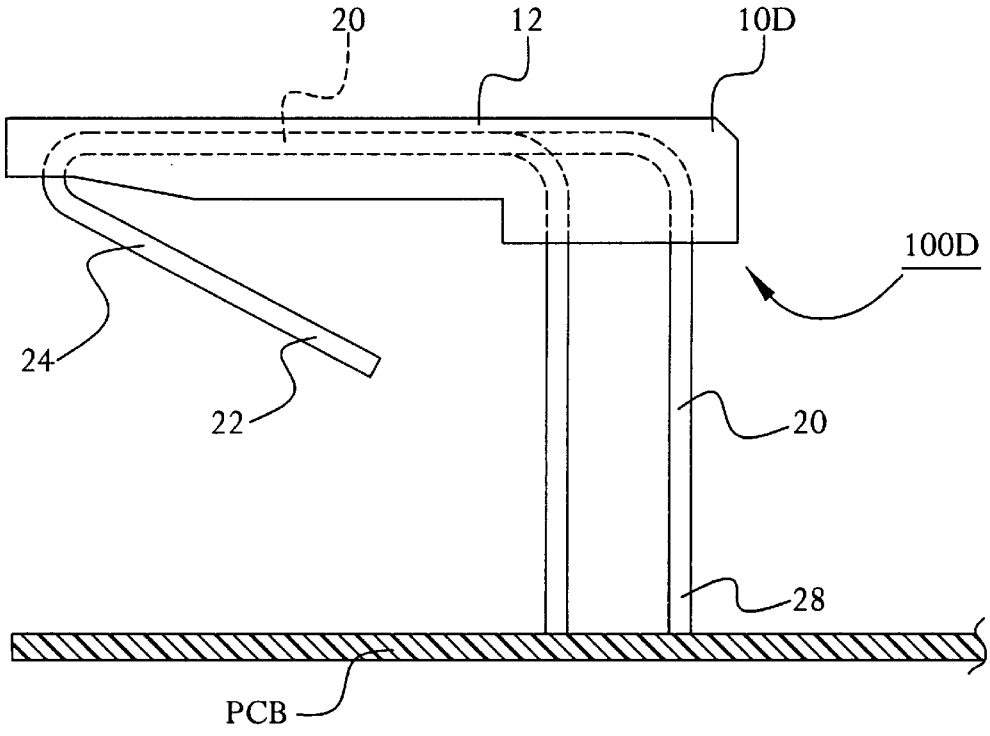
FIG. 12 is a side view of a fifth preferred embodiment of a receptacle of the present invention.

A side view of a fifth preferred embodiment, receptacle 100D, of the present invention is shown in FIG. 12. The housing 10D of the receptacle 100D comprises only a top wall 12 which is supported by the contacts 20. A top view of the cut-out portion 34D of the PCB 30D on which the receptacle 100D is mounted is shown in FIG. 13. This PCB 30D has two arms 31 and 33 for receiving the latch arm 82 of the telecommunications plug 80. Variations of receptacle 100D also are contemplated. For example, the housing 10D may comprise a rear wall 14 in addition to the top wall 12 or may comprise only a rear wall 14.

The embodiments of the receptacle of the present invention can be manufactured for any size of telecommunications plugs and jacks, i.e., having 4, 6 or 8–10 position plugs (contacts). Each receptacle also is designed according to the Federal Communications Commission (FCC) standard datum line, a reference line from which every receptacle must be manufactured so that each receptacle may receive any telecommunications plug 80, as described in FCC Rules Part 68F.

With all of the embodiments of a receptacle of the present invention, an enclosure that covers the PCB 30 and the receptacle may aid in receiving the telecommunications plug 80 and/or "catch" its latch arm 82. As described above in reference to the preferred embodiments, the receptacle of the present invention utilizes less material than conventional receptacles and takes up less space on a PCB than conventional receptacles. Moreover, the receptacle of the present invention in combination with the required area on a PCB is achieved with less material than conventional receptacle/PCB combinations.

It is to be understood that even though numerous characteristics and advantages of the present invention have been set forth in the foregoing description, together with details of the structure and function of the invention, the disclosure is illustrative only. Accordingly, changes may be made in detail, especially in matters of shape, size and arrangement of parts within the principles of the invention to the full extent indicated by the broad general meaning of the terms in which the appended claims are expressed.

What is claimed is:

1. A receptacle and printed circuit board combination for receiving a plug and achieving electrical connection between the plug and a printed circuit board, the combination comprising:

an insulating housing having a front, rear, bottom surface and top wall, the housing forming a chamber for receiving the plug, the housing further having an open bottom in communication with said chamber;

a plurality of electrical contacts, each having a first end portion extending within the opening for engaging the plug, and a second end portion connectable to the circuit board; and the printed circuit board having a cut-out portion for receiving the receptacle, wherein said cut-out portion overlaps said chamber, and at least a portion of said cutout portion resides within a periphery of said chamber to engage the plug;

wherein the receptacle further comprises a peg extending from the bottom surface of the housing for mounting the receptacle on the circuit board, the cut-out portion of the circuit board receiving the peg.

2. The receptacle and printed circuit board combination of claim 1, wherein the cut-out portion of the circuit board for receiving the receptacle has a substantially rectangular shape.

3. The receptacle and printed circuit board combination of claim 2, wherein the housing further comprises:

two side walls extending between the top wall and the bottom surface; and two ledges, each ledge extending from each side wall such that the ledges make contact with the circuit board when mounted on the circuit board.

4. The receptacle and printed circuit board combination of claim 3, wherein an underside of the ledges is coplanar with the bottom surface.

5. The receptacle and printed circuit board combination of claim 3, wherein the two ledges extend from their respective side walls toward each other.

6. The receptacle and printed circuit board combination of claim 5, wherein the ledges have respective ledge extensions extending down and substantially perpendicularly from the ledges at the front of the housing to help anchor the receptacle in place on the circuit board by making contact with an edge of the circuit board.

7. The receptacle and printed circuit board combination of claim 6, wherein the ledge extensions have respective lips extending from the ledge extensions toward each other such that the receptacle can receive a latch arm of the plug.

8. The receptacle and printed circuit board combination of claim 7, wherein the lips are joined together by a connecting member extending between lower surfaces of the two lips.

9. The receptacle and printed circuit board combination of claim 1, wherein the peg is a latch.

10. A receptacle and printed circuit board combination for receiving a plug and achieving electrical connection between the plug and a printed circuit board, the combination comprising:

an insulating housing located a distance from the circuit board, the housing and circuit board forming a plug receiving opening;

a plurality of electrical contacts, each having a first end portion extending from the housing and into the opening, and a second end portion connectable to the circuit board; and the printed circuit board having a cut-out portion for receiving a latch arm on the plug.

11. A receptacle and printed circuit board combination for receiving a plug and achieving electrical connection between the plug and a printed circuit board, the combination comprising:

an insulating housing located a distance from the circuit board, the housing and circuit board forming a plug receiving opening;

a plurality of electrical contacts, each having a first end portion extending from the housing and into the opening, and a second end portion connectable to the circuit board; and the printed circuit board having a cut-out portion for receiving a latch arm on the plug, wherein the cut-out portion is defined by a first substantially rectangular section and a smaller substantially rectangular extension adjacent a leading edge of the circuit board.

12. A receptacle and printed circuit board combination for receiving a plug and achieving electrical connection between the plug and a printed circuit board, the combination comprising:

an insulating housing having only:

a top wall having a front and rear; and a rear wall, wherein the top wall is situated above the circuit board and the housing and circuit board forms a plug receiving opening;

a plurality of electrical contacts, each having a first end portion extending from the housing to mate with contacts in the plug and a second end portion fixed to the circuit board; and the printed circuit board having a cut-out portion for receiving a latch arm on the plug.

13. An electrical connector system, comprising, in combination:

a circuit substrate having a cut-out portion; and an electrical connector mountable to said circuit substrate so as to surround said cut-out portion, said connector including:

a housing having a chamber adapted to receive a mating electrical connector, and an open bottom in communication with said chamber; and a plurality of contacts extending through said housing and into said chamber to engage corresponding contacts on said mating connector;

wherein said cut-out portion overlaps said chamber, and at least a portion of said cut-out portion resides within a periphery of said chamber to engage said mating connector.

14. The connector system as recited in claim 13, wherein said portion of said circuit substrate comprises an area adjacent said cut-out portion.

15. The connector system as recited in claim 13, wherein said housing includes opposed side walls that define a width of said chamber, said cut-out portion having a width less than said width of said chamber.

16. The connector system as recited in claim 13, further comprising a mating connector receivable in said chamber.

17. The receptacle and printed circuit board combination of claim 10, wherein the insulating housing has only a top wall having a front and rear.

* * * * *